United States Patent [19]

Chevalier

[11] Patent Number: 4,823,954

[45] Date of Patent: Apr. 25, 1989

[54] PACKAGE PROVIDED WITH ADHESIVE FLAPS

[76] Inventor: Pierre A. Chevalier, 31, boulevard d'Auteuil, Boulogne (92100), France

[21] Appl. No.: 106,887

[22] Filed: Oct. 13, 1987

Related U.S. Application Data

[63] Continuation of Ser. No. 406,764, Aug. 10, 1982, abandoned.

[30] Foreign Application Priority Data

Nov. 9, 1981 [FR] France ..... 81 17200

[51] Int. Cl.[4] ..... B65D 81/14

[52] U.S. Cl. ..... 206/424; 53/450; 53/461; 229/87 R

[58] Field of Search ..... D19/26; 206/232, 424, 206/425, 450, 472; 229/40, 87 R, DIG. 3, 147, 154, 917; 281/19 R, 31, 34, 42, 45; 402/73–78; 53/450, 461

[56] References Cited

U.S. PATENT DOCUMENTS

| | | | |
|---|---|---|---|
| 2,553,923 | 5/1951 | Lambert | 229/87 R |
| 2,783,933 | 3/1957 | Sharts | 229/195 |
| 2,978,163 | 4/1961 | Anderson, Jr. | 206/591 |
| 3,064,875 | 11/1962 | Mairs | 206/424 |
| 3,119,542 | 1/1964 | Pomerantz | 206/586 |
| 3,297,341 | 1/1967 | Reed et al. | 281/34 |
| 3,512,823 | 5/1970 | D'Esposito et al. | 229/17 |
| 3,664,573 | 5/1972 | Partain et al. | 279/40 |
| 3,666,168 | 5/1972 | Partain et al. | 206/424 |
| 3,720,366 | 3/1973 | Martin | 229/37 E |
| 3,722,668 | 3/1973 | Carpenter | 229/40 |
| 4,090,608 | 5/1978 | McCall | 229/40 |
| 4,114,757 | 9/1978 | Sieffert | 206/424 |
| 4,265,393 | 5/1981 | Orchard | 229/40 |
| 4,300,679 | 11/1981 | Benzschawel et al. | 229/40 |

FOREIGN PATENT DOCUMENTS

| | | | |
|---|---|---|---|
| 2082000 | 12/1971 | France . | |
| 2123215 | 9/1972 | France . | |
| 2161351 | 7/1973 | France . | |
| 2311729 | 8/1979 | France . | |
| 2415048 | 9/1979 | France | 229/40 |
| 0475139 | 8/1969 | Switzerland | 206/424 |

*Primary Examiner*—Jimmy G. Foster
*Attorney, Agent, or Firm*—Lane and Aitken

[57] ABSTRACT

The package is of the type comprising two lateral symmetrical flaps 12 and 13 which can be applied against one large surface of the package. An adhesive tape 26 is provided at least on the flaps 12 and 13. Tongues 18 and 19 are used for wedging action with respect to the packaging of objects. In another embodiment notches 30, 31, 32 and 33 are used into which the flaps 12 and 13 can be bent. Application for packaging objects of different height.

24 Claims, 2 Drawing Sheets

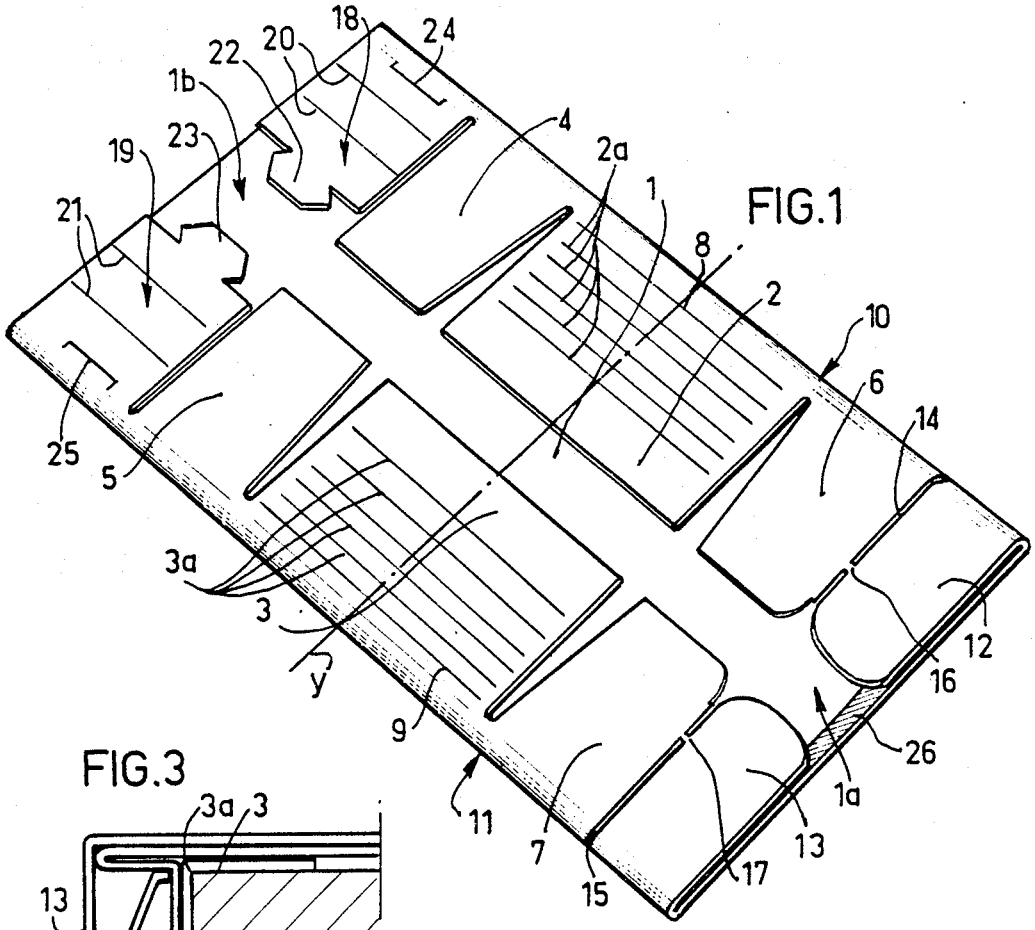
FIG.1
FIG.3
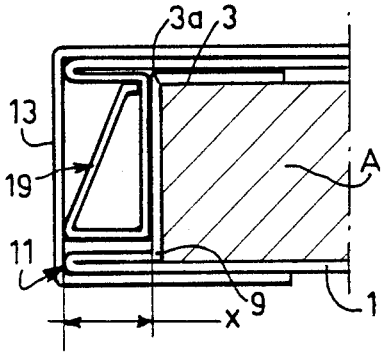
FIG.2
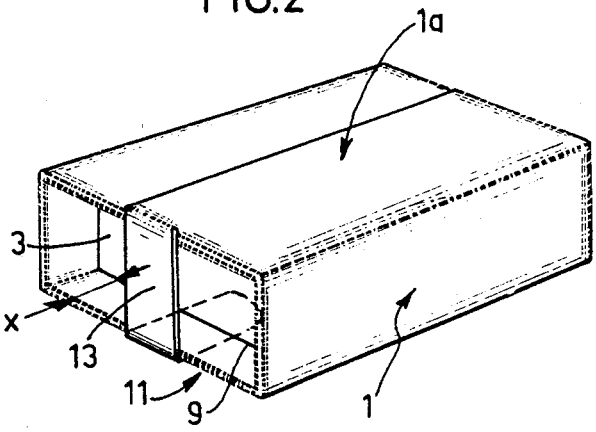
FIG.4
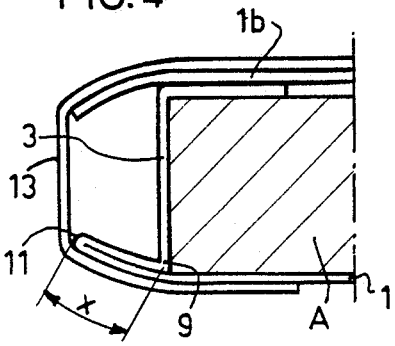

PACKAGE PROVIDED WITH ADHESIVE FLAPS

This is a continuation of application Ser. No. 406,764, filed Aug. 10, 1982, now abandoned.

The invention relates to packages to be folded, having symmetrical flaps and being provided with adhesive tape for closing.

BACKGROUND OF THE INVENTION

The steps of automatic packaging of objects into containers, especially of cardboard, are carried out by machines which take care of all the necessary operations, including the closing by gluing, stapling or the like.

However, when the packaging is done by hand, the step of closing is always difficult and time-consuming.

This is, for example, the case when books or records are packed in cardboard containers for mailing.

Closing usually takes place by folding down certain portions, such as walls or flaps, which operation is followed by a gluing step using an adhesive tape of any known type.

SUMMARY OF THE INVENTION

It is an object of the present invention to simplify and streamline the operation of closing of packages for this type of packing. It can also be used as a step in mechanized automatic packaging machines.

A package according to the invention, particularly one of cardboard, is of the type comprising a blank forming a base before being folded to hold objects to be packaged, characterized in that it comprises two lateral symmetrical flaps which have such a length that after folding of the blank, their ends can be applied against the large surface of the package, which surface lies opposite the one which is integral with the flaps, regardless of the height of the possible lateral surfaces, with an adhesive tape being provided at least on the flaps and preferably on the entire length which extends from one end of a flap to the end of the other one.

Other features of the invention are:

the two symmetrical flaps are bent back inside the outline of the blank prior to use, and are adapted, after folding of the blank, to be unfolded and then pressed down at the outside of the outline of the blank and, finally, applied against the large surface of the package which lies opposite the one with which they are integral;

the package comprises in a manner known per se, tabs as well as reinforcements, with the flaps being defined by an end of the blank and by parallel slits at said end;

the package, in a manner known per se, has two lateral surfaces which are set back at a certain depth relative to the lateral edges of the other surfaces of the package, with the flaps being applied under tension against the large surface of the package which lies opposite to the one being integral with the flaps so that the edges of the large surfaces are deformed with respect to each other to wedge in the packaged objects laterally;

the package comprises in a manner known per se, tongues, each of which to be folded back upon itself to form wedging means adapted to be positioned opposite the lateral surfaces which are set back, when the package is in position of use, with the flaps and the tongues being symmetrical with respect to an imaginary median transverse line of the blank, so that after setting up the package, the flaps pressed down under the lateral surfaces which are set back, are positioned, at least partially, opposite the wedges;

the lateral edges of the two large surfaces are provided with notches, and the parallel slits at the end of the reinforcements are extended in the blank at a distance equal to the depth of the notches so that the flaps can be bent against the bottom of said notches.

BRIEF DESCRIPTION OF THE DRAWING

The invention will be better understood by reading the following detailed description in which reference is made to the attached drawing. It is to be noted that the description and drawing are not exclusive but give only examples.

FIG. 1 is a perspective view of an undulated cardboard blank, laterally folded upon itself to form reinforcements and tabs for holding objects in place;

FIG. 2 is a perspective view of a finished package, containing objects to be packaged, obtained from a blank as shown in FIG. 1;

FIGS. 3 and 4 are partial schematic sectional views of two embodiments of a finished package of the same type as the one described above;

Detailed Description

Figure 5:
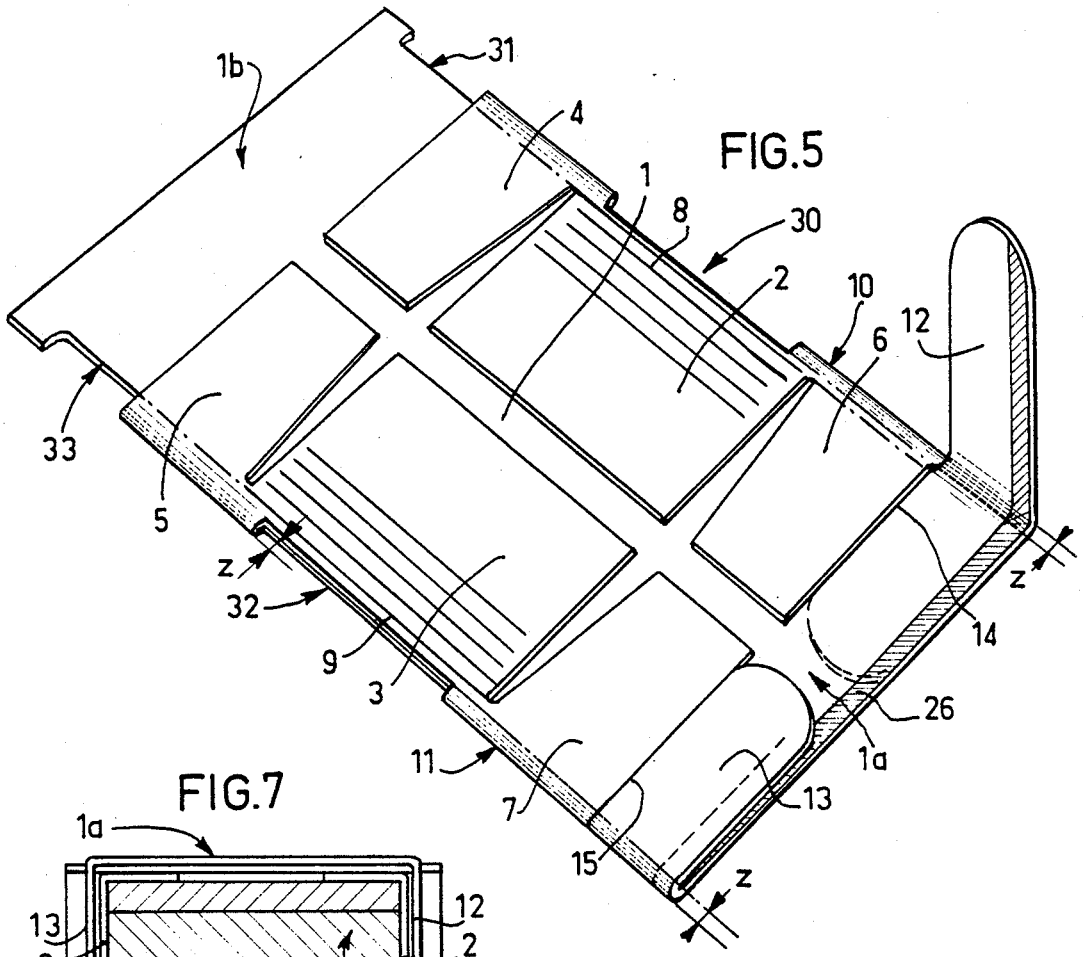
FIG. 5 is a perspective view of an undulated cardboard blank, folded upon itself to form reinforcements and tabs to hold objects to be packaged, of the type having lateral notches.

Referring now to FIG. 1, a package of known type is shown which is formed of an undulated carboard blank constituting the blank 1 on which two tabs 2 and 3 are folded as well as the reinforcements 4–5 and 6–7, respectively, which are positioned on both sides of the tabs 2 and 3.

As is already known per se, the tabs 2 and 3 are applied against the blank which forms the base 1, up to a base deflecting line 8 and 9, respectively, especially by gluing or stapling.

In regard to the longitudinal folds 10 and 11, along which the elements described above are folded on the blank 1, the base deflecting lines 8 and 9 are at a distance x, as can be especially well seen on FIGS. 2 to 4. The folds 10 and 11 define the side or lateral edges of the middle and end portions of the blank 11.

According to the invention, two flaps 12 and 13 are obtained together with the reinforcements 6 and 7 and are bent back, while being separated from each other by two slits 14 and 15, respectively, which are interrupted to form bridges 16 and 17, due to which the flaps 12 and 13 remain suitably applied against the inside of the outline of the blank 1 like the reinforcements 6 and 7. All this allows easy handling.

Beside the reinforcements 4 and 5 there are two tongues 18 and 19, respectively, which are provided with transverse folding lines 20 and 21. The tongues 18 and 19 are bent on the fold lines 20 and 21, specifically, into triangular wedge shapes to allow engagement of the end flaps 22 and 23 in the slits 24–25, respectively, to form on each side of the finished package wedges, one of which can be seen in FIG. 3.

These wedges which are formed by bending of a tongue are placed exactly into the space of the depth x which exists between the edge or the lateral fold of the package (in FIG. 3 the fold 11) and the line along which the tabs 2 and 3 are set (line 9 in FIG. 3).

To properly package objects, and particularly books and records which vary in height, the tabs 2 and 3 are set along the base deflecting lines 8 and 9, whereupon the objects are placed directly onto the middle portion of the blank 1. Then the free ends of the tabs 2 and 3 are pressed down on the upper side of the piled-up objects by making use for that purpose of pre-marked fold lines 2*a* or 3*a*, as is known per se.

Thereafter, the wedges are formed by bending the tongues 18 and 19, and the end of the flaps 12 and 13 is set by breaking the bridges 16 and 17 which are sufficiently small to be broken without effort.

Now it is possible to finish packaging by folding the blank 1 transversely upon itself so that it surrounds the objects which were placed onto the blank 1 with the end portions 1*a* and 1*b* wrapped around the objects. The end portion 1*a* of said blank is pressed down upon the opposite end 1*b* which leads to a package of the type shown in FIG. 2.

The end portion 1*a* as well as the flaps 12 and 13 were first provided with an adhesive tape 26 which preferably extends continuously along one transverse edge of the blank 11 from the end of the flap 12 to the end of the flap 13 or on the flaps 12 and 13 only.

When the package is formed, the flaps 12 and 13 are pressed down laterally at the outside of the outline of the blank 1 so that they can pass in front of the surfaces 2 and 3 of the package which are set back, and are glued to the large surface of the package which lies opposite to the one which is formed by superimposition of the ends 1*a* and 1*b*. With the adhesive tape extending on the end portion 1*a*, the end portion 1*a* will glue to the end portion 1*b* when it is pressed down thereon.

It can be seen that thanks to the invention the shape of the package itself is in no way modified, and on the other hand closing the package is very easy since the tape 26 can without difficulty be provided with an effective adhesive of simple usage.

The result is that closing of such a package is carried out in a simple, rapid and practically automatic way contrary to methods used up to now where an independent adhesive tape has to be used or a bond such as an elastic means or a string to be tied.

FIG. 3 shows an embodiment in which tongues 18 and 19 are provided to form wedges. In this case the dimensions and the arrangement of the different elements of the package are established in such a way that the flaps 12 and 13, on the one hand, are symmetrical with respect to a median transverse imaginary line y of the blank 1, so that after formation of the package the flaps 12 and 13, folded onto the lateral surfaces which are set back, are, at least partially, positioned opposite the wedges 18 and 19.

Thus the wedges can under no circumstances get disassociated accidentally during transportation by extraction of the flaps 22 and 23 from the slits 24 and 25, since the flaps 12 or 13 are positioned opposite the wedges.

Moreover, the flaps 12 and 13 have a tendency to press the wedges against the set portion of the tabs and, consequently, against the packaged objects A which are thus conveniently immobilized laterally.

But, as is known, such a package can also be without a wedge, which means that it is devoid of tongues 18 and 19.

It can also do without reinforcements 4, 5, 6 and 7.

A package of this type is simpler and ligher, especially since it was only the simple thickness of the cardboard for forming the blank 1 instead of having a double thickness due to the reinforcements 4, 5, 6 and 7. Such a package is correspondingly more fragile, of course, but more economical.

According to a modification of the invention, the package can be made more rigid and the packaged objects A can be wedged more strongly by applying the flaps 12 and 13 under tension against the large surface of the package which lies opposite the one on which there are the end portions 1*a* and 1*b*, so that the lateral or side edges of the middle portion of the blank 11 and the end portions 1*a* and 1*b* are deformed one against the other, as is shown in FIG. 4, for wedging in the packaged objects A laterally and for giving the lateral faces 2 and 3 of the package a kind of prestressing which contributes effectively to its solidity.

If the modification is used where lateral wedges are employed, it can be arranged that said wedges have a substantially triangular or trapezoidal section a shown in FIG. 3 or, preferably, a rectangular section due to which the wedge has an outer edge which is not inclined as shown in FIG. 3, but is vertical so that the flaps 12 and 13 can apply themselves onto the entire length of the exterior surface of the wedge. An effect is attained in this way which can be compared to the one obtained with pinching as shown in FIG. 4, since by applying the flaps 12 and 13 strongly, the objects to be packaged are blocked laterally.

It is obvious that the embodiments described above are still more effective when the adhesive tape 26 is applied on the exterior surface of the wedge, because in this manner under no circumstances need it then be displaced laterally, and the entire package has considerable rigidity which is favorable for attaining a solid condition.

Figure 7:
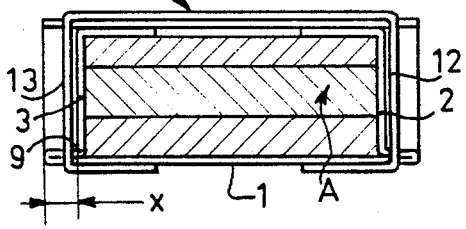
FIG. 7 is a schematic view in section along the line VII—VII in FIG. 6.
Figure 6:
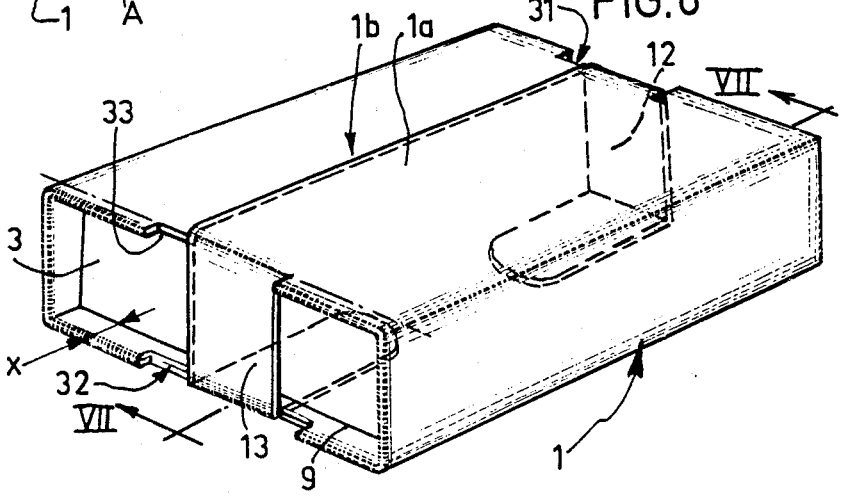
FIG. 6 is a perspective view of a finished package, containing objects, said package having been obtained from a blank as shown in FIG. 5.

Referring now to FIGS. 5 to 7, an embodiment of the same type of package as the one just described is shown there with some close modifications.

In particular, it can be noticed that the tongues 18 and 19 are not present any more. Instead, four notches 30, 31, 32 and 33 are provided at the longitudinal edges 10 and 11 at a depth Z.

The same elements as those in FIGS. 1 to 4 have the same references.

A package of this type which is made in a known manner, can only be closed by a closing means as named before, i.e. an adhesive tape, an elastic ring or a tied string.

In general, such a closing means is placed longitudinally with respect to the axis of the blank 1, i.e. transversely too the end portion, 1*a* and 1*b* when the package is completed.

But by providing the notches 30 and 33, it is possible to put the closing means transversely on the finished package and to see to it that the closing means engages the notches which are alined two by two: 30 and 31 on the one hand and 32 and 33 on the other hand.

The edges of these notches assure the engagement of the closing means and obviate its sliding off.

According to the present invention, the notches 30 to 33 are arranged in such a way that the flaps 12 and 13 are also placed in the notches by passing before the lateral surfaces which are set back, as is shown in FIGS. 6 and 7.

So that the flaps 12 and 13 can be pressed down to the same level as the bottom of the notches, the parallel slots 14 and 15 at the end of the reinforcements 6 and 7 are extended on the actual blank 1 at a distance Z which is equal to the depth Z of the notches, so that the flaps 12 and 13 can be pressed down against the bottom of said notches 30 to 33.

The invention applies to simple packages without lateral sides also and not only to the examples given.

As a matter of fact, a package according to the invention has an adjustable height according to the thickness of the object to be packaged. If it is very flat (for example just one sheet which is to be protected against accidental folding), there are not really any lateral surfaces. If, however, the object is thick, like a book, several books, a number of magazines, a packet of records etc., the tabs 2 and 3 are bent so as to have the desired height. They thus form regular lateral surfaces, adjacent to the two large surfaces (upper and lower).

The area where the glue is applied varies from one package to another in accordance with what is contains.

As a result of the invention, the two parallel planes which constitute the two opposed large surfaces are made integral, clearing the lateral surfaces regardless of their height, assuring gluing in every case by means of the adhesive band which is covered prior to use by a removable strip.

I claim:

1. A wrapped package comprising:

an article and a packaging wrapper defined by a cardboard sheet, said packaging wrapper having a plurality of portions, including a middle portion and first and second end portions extending from said middle portion and extending around the article so that said end portions overlap on one side of the article, said packaging wrapper further having deflected tabs secured along lateral edges of one of said portions, said tabs extending from said one portion and being pressed against the article and toward said one portion by at least one of said end portions, a portion of said tabs lying between the article and said end portions, flaps under tension extending from said first end portion to an outside surface of said middle portion, and means for securing said flaps under tension to said middle portion.

2. A wrapped package as recited in claim 1, wherein said tabs extend from one side wof said article beyond an opposite side of said article; one of said portions of said packaging wrapper comprises means for pressing said tabs against the side of the article beyond which the tabs extend; and the portion of the packaging wrapper pressing said tabs against the article is held in its pressing condition by said flaps under tension.

3. A method of enclosing an article by using a packaging wrapper including a cardboard sheet of fixed length extending between first and second transverse edges of said cardboard sheet and having a middle portion, a first end portion extending between said first transverse edge and said middle portion, and a second end portion extending between said second transverse edge and said middle portion, tabs secured to side edges of said middle portion, said tabs each having a base deflecting line defined therein displaced from said side edges of said middle portion, said end portions being adapted to wrap around articles of different heights placed on said middle portion, said cardboard sheet further including flaps attached to opposite side edges of said first end portion adjacent to said first transverse edge, said flaps being of sufficient length to fold around to the outside surface of said middle portion when said end portions are wrapped around an article placed on said middle portion, and means for securing said flaps to the outside surface of said middle portion when said end portions are wrapped around an article placed on said middle portion, comprising:

deflecting each tab away from the middle portion along the base line deflecting line to expose an area of the middle portion at least equal to the area of the article;

placing the article on said middle portion;

pressing each tab back over the article;

wrapping said end portions of the packaging wrapper successively over the article;

folding the flaps on said first end portion around the side edges of the middle portion to the outside surface of the middle portion; and attaching the flaps under tension to the middle portion.

4. A method of enclosing an article as recited in claim 1, wherein the tabs are secured to the middle portion at a point displaced inwardly from the side edges of the middle portion, and the side edges of the middle portion and side edges of the end portions extend beyond the article, and the step of attaching the flaps under tension to the middle portion includes bringing the side edges of the middle portion and of the first and second end portions toward each other.

5. A method of enclosing an article as recited in claim 1, wherein the tabs are secured to the middle portion at a point displaced inwardly from the side edges of the middle portion, and the side edges of the middle portion and side edges of the end portions extend beyond the article, and the cardboard sheet includes tongues attached to the side edges of the second end portion adjacent to said second trasverse edge, and the method further comprises folding the tongues to extend from the tabs to the flaps so that applying the flaps under tension to the middle portion keep the tongues against the tabs to hold the article in place.

6. A method of enclosing an article as recited in claim 1, wherein the method further comprises securing the first end portion to the second end portion.

7. A method of enclosing an article as recited in claim 1, wherein notches are defined in the side edges of said middle portion and said second end portion, and the step of folding the flaps comprises extending the flaps through said notches.

8. A method of enclosing an article as recited in claim 3, wherein said tabs each have a plurality of fold lines defined therein displaced from said base deflecting line, and the method further comprises:

folding each tab back along one of said fold lines.

9. A wraped package comprising an article and a packaging wrapper defined by a cardboard sheet, said packaging wrapper having a middle portion and first and second end portions extending from said middle portion and extending around the article so that said end portions overlap on one side of the article, deflected tabs secured along lateral edges of said middle portion, said tabs extending from said middle portion and being pressed against the article and toward said middle portion by at least one of said end portions, a portion of said tabs lying between the article and at least one of the end portions, flaps under tension extending from said first end portion to an outside surface of said middle portion, and means for securing said flaps under tension to said middle portion.

10. A wrapped package as recited in claim 9, wherein said securing means comprises adhesive.

11. A wrapped package as recited in claim 10, wherein said adhesive is on said flaps.

12. A wrapped package as recited in claim 9, further comprising means for securing said first end portion to said second end portion.

13. A wrapped package as recited in claim 12, wherein said means for securing said first end portion to said second end portion comprises adhesive.

14. A wrapped package as recited in claim 9, wherein said middle portion and said first and second end portions have side edges extending laterally beyond the article, and said flaps under tension deflect the side edges of said first and second end portions toward the side edges of said middle portion, and the side edges of the middle portion toward said first and second end portions, thereby transmitting a force urging the article toward the center of the package.

15. A wrapped package as recited in claim 9, wherein said middle portion and said first and second end portions have side edges extending laterally beyond the article, and the packaging wrapper further includes folded tongues attached to said second end portion and extending from said tabs to said flaps under tension.

16. A wrapped package as recited in claim 9, wherein notches are defined in the side edges of said middle portion and the side edges of said second end portion, and said flaps under tension extend through said notches.

17. A wrapped package as recited in claim 9, wherein reinforcing tabs are attached to the side edges of said first end portion, extending between said first end portion and the article, said reinforcing tabs being separated from said flaps under tension by slits.

18. A wrapped package as recited in claim 9, wherein each said tab extends from its associated lateral edge toward the center of said middle portion.

19. A wrapped package as recited in claim 9, wherein the cardboard sheet of the packaging wrapper includes corrugations.

20. A wrapped package as recited in claim 9, wherein said tabs each have a plurality of fold lines defined therein displaced from said base deflecting line.

21. A method of enclosing an article by using a packaging wrapper including a cardboard sheet of fixed length extending between first and second transverse edges of said cardboard sheet and having a plurality of portions, including a middle portion, a first end portions extending between said first transverse edge and said middle portion, and a second end portion extending between said second transverse edge and said middle portion, tabs secured to side edges of one of said portions, said tabs each having a base deflecting line displaced from said side edges of the portion to which said tabs are secured, said portions being adapted to wrap around articles of different heights placed on the portion to which said tabs are secured, said cardboard sheet further including flaps attached to opposite side edges of one of the other portions, wherein said other portion is said first end portion and the flaps are attached adjacent to said first transverse edge, said flaps being of sufficient length to fold around to the outside surface of said middle portion when said end portions are around an article placed on the portion to which the tabs are secured, and means for securing said flaps to the outside surface of said middle portion when said end portions are around an article placed on the portion to which said tabs are secured, comprising:

deflecting each tab away from the portion to which the tab is secured along the base deflecting line to expose an area of the portion to which the tabs are secured at least equal to the area of the article;

placing the article on the portion to which the tabs are secured, leaving the other portions unencumbered;

pressing each tab back over the article;

wrapping said unencumbered portions successively over the article;

folding the flaps of said first end portions around the side edges of the middle portion to the outside surface of the middle portion; and attaching the flaps under tension to the middle portion.

22. A method of enclosing an article as recited in claim 21, wherein said tabs each have a plurality of fold lines defined therein displaced from said base deflecting line, and the method further comprises:

folding each tab back alone one of said fold lines.

23. A method of enclosing an article as recited in claim 21, further comprising:

pressing the tabs against the article by engaging the tabs with one of the unencumbered portions; and holding the portion engaging the tabs in its pressing condition when attaching the flaps under tension to the middle portion.

24. A wrapped package as recited in claim 23, wherein said tabs each have a plurality of fold lines defined therein displaced from said base deflecting line.

* * * * *